US006267205B1

(12) United States Patent
Piech et al.

(10) Patent No.: US 6,267,205 B1
(45) Date of Patent: Jul. 31, 2001

(54) MAGNETIC GUIDANCE FOR AN ELEVATOR ROPE

(75) Inventors: Zbigniew Piech, Cheshire; Pedro Baranda, Farmington, both of CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/551,686

(22) Filed: Apr. 18, 2000

(51) Int. Cl.[7] ..... B66B 1/34
(52) U.S. Cl. ..... 187/292; 187/414
(58) Field of Search ..... 187/281, 292, 187/414, 258, 261, 262, 264, 361, 362, 409, 410; 212/274, 76, 99, 114, 115, 345; 254/266, 271, 272

(56) References Cited

U.S. PATENT DOCUMENTS

| | | | | |
|---|---|---|---|---|
| 3,610,583 | * | 10/1971 | Ostrom | 254/150 |
| 3,860,109 | * | 1/1975 | Benzmiller | 254/175 |
| 4,460,065 | | 7/1984 | Saxer | 187/29 R |
| 4,566,264 | * | 1/1986 | Garner | 57/314 |
| 5,036,955 | * | 8/1991 | Nakai et al. | 187/107 |
| 5,193,651 | * | 3/1993 | Shigeta et al. | 187/95 |
| 5,351,788 | | 10/1994 | DeJong | 187/264 |
| 5,581,180 | * | 12/1996 | Ito et al. | 324/207.11 |
| 5,630,427 | * | 5/1997 | Hastings | 128/772 |
| 5,715,914 | | 2/1998 | Traktovenko | 187/410 |
| 5,738,339 | * | 4/1998 | Kuryu | 254/267 |
| 5,810,120 | * | 9/1998 | Jamieson et al. | 187/292 |
| 5,857,545 | | 1/1999 | Barrett et al. | 187/249 |
| 5,864,102 | * | 1/1999 | Jamieson et al. | 187/292 |
| 5,881,843 | | 3/1999 | O'Donnell et al. | 187/254 |
| 5,881,845 | | 3/1999 | O'Donnell et al. | 187/411 |
| 5,899,301 | * | 5/1999 | Aulanko et al. | 187/266 |
| 5,950,771 | | 9/1999 | Ferrisi et al. | 187/411 |
| 5,955,709 | | 9/1999 | Traktovenko et al. | 187/292 |

* cited by examiner

*Primary Examiner*—Jonathan Salata

(57) ABSTRACT

An elevator system includes a magnetic guide that dampens vibration of a flat rope that move the car and counterweight up and down in the hoistway. The flat rope is guided through an opening in the magnetic guide between a pair of ferromagnetic flux concentrators having a set of teeth. The flux concentrators concentrate a centralizing magnetic flux that centers the ferromagnetic wires of the rope between each tooth. As the centralizing force acts on each ferromagnetic wire, the flat rope will be magnetically laterally centered within the opening of the magnetic guide and vibration of the flat rope is accordingly dampened. In one example implementation of this invention, the magnetic guide is slideably mounted on a slide assembly in response to rope migration. The slide assembly operates in combination with the magnetic guide at particular locations throughout the elevator drive system to restrain undesirable rope vibration and migration without contact between the guide system and rope and reduces undesirable frictional forces.

10 Claims, 3 Drawing Sheets

MAGNETIC GUIDANCE FOR AN ELEVATOR ROPE

BACKGROUND OF THE INVENTION

This invention relates to a rope for an elevator system, and more particularly to a magnetic guide assembly for minimizing undesirable movements of the elevator system rope.

A conventional traction type elevator includes a cab mounted in a car frame, a counterweight attached to the car frame by a rope, and a drive assembly including a machine driving a traction sheave that engages the rope. As the machine turns the sheave, friction forces between the sheave and the rope move the rope and thereby cause the car frame and counterweight to raise and lower.

A limiting factor in the use of ropes, however, is their durability. As the ropes pass through the sheave they have the tendency to migrate from side to side and contact the sheave rope separators. Contact with the separators increases frictional forces that cause significant abrasion and can degrade the rope materials. Such undesirable migration and resulting friction may also be problematic for flat ropes such as coated steel belts (CSB) that are guided through additional elevator drive components such as rope support roller assemblies attached to the car frame and counterweight.

It is therefore desirable to guide the rope at particular locations throughout the elevator drive system to restrain undesirable movement and vibration of the rope. It would also be particularly desirable to minimize contact between the guide system and rope to further reduce undesirable frictional forces.

SUMMARY OF THE INVENTION

An elevator system designed according to this invention includes a magnetic guide to restrain undesirable rope vibration and migration without contact between the guide system and rope while reducing undesirable frictional forces. The flat rope is guided through an opening in the magnetic guide between a pair of ferromagnetic flux concentrators. Preferably, a number of teeth on each flux concentrator has a numerical relationship to the number of ferromagnetic wires in the rope. Most preferably, the number of tooth pairs is equal to the number of wires in the rope. Each tooth of the first flux concentrator faces an associated tooth of the second flux concentrator. One of the ferromagnetic wires of the rope preferably is located between the first and second flux concentrators.

The ferromagnetic flux concentrators effectively concentrate the magnetic fields from a pair of magnets into the ends of the teeth. Due to the polarity directions of the magnets, the resulting magnetic field is concentrated as a magnetic flux across each pair of facing teeth and each ferromagnetic wire. In this way, each ferromagnetic wire becomes a part of a magnetic circuit that creates a centralizing magnetic flux. The magnetic flux is intended to minimize reluctance by maintaining the ferromagnetic wire in the center between each facing pair of teeth. As the force associated with the centralizing flux acts on each ferromagnetic wire, the flat rope is magnetically laterally centered within the opening of the magnetic guide and undesirable vibration and migration of the flat rope is accordingly dampened.

In one disclosed embodiment, the magnetic guide is slideably mounted on a slide assembly. As the flat rope is driven by the sheave, the flat rope typically migrates from side to side between the sheave belt separators. The magnetic guide slides along the slide assembly in response to the rope migration until the magnetic guide contacts a lateral stop. The slide stop prevents further migration and thus prevents contact between the flat rope and the rope separators. The slide assembly can operate in combination with the magnetic guide to prevent contact and the resulting friction between the flat belt and the belt separators.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
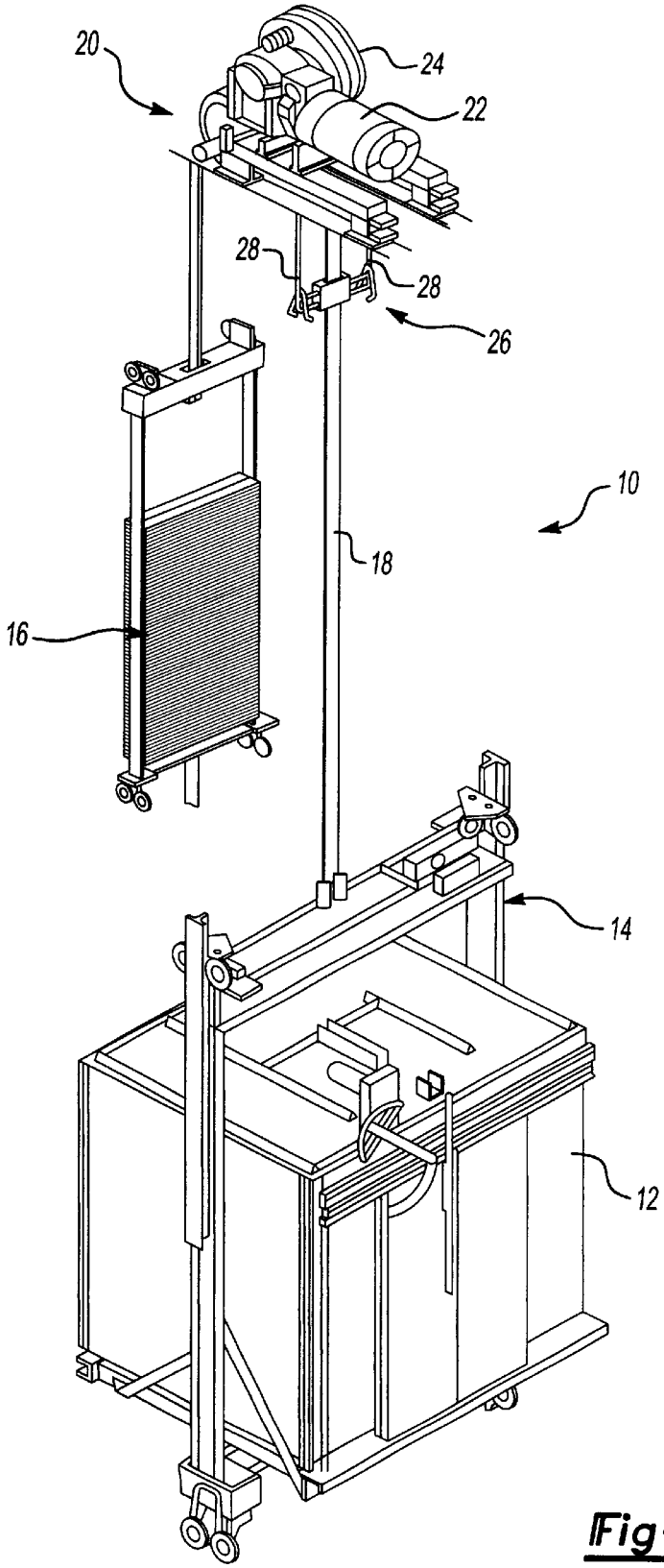
FIG. 1 is a general perspective view of an elevator system designed according to this invention.

FIG. 1 illustrates an elevator system 10 with the hoistway and hoistway components, such as the guide rails, removed for clarity. The elevator system 10 includes a car 12 supported on a car frame 14. A counterweight 16 balances the car 12 in a known manner. Operation of an elevator car with counterweight 16 is known and will not be discussed here in detail.

The car 12 and counterweight 16 are attached to a drive assembly 20 including a drive motor 22, and a traction sheave 24 by a rope 18. The rope 18 extends over the traction sheave 24 and through a guide assembly 26. Although a particular rope path is illustrated, it should be apparent to one skilled in the art that other roping paths, car attachments, counterweight attachments and various sheave attachments can take advantage of the present invention.

The drive motor 22 provides the actuating force to turn the traction sheave 24. Frictional forces between the sheave 24 and the rope 18 provide traction to pull the rope 18, and thereby move the car 12 and counterweight 16 up and down in the hoistway.

The rope 18 preferably is a coated steel belt (CSB) flat rope 18 that is routed through the guide assembly 26. The guide assembly 26 in one example implementation of this invention is illustrated as attached to the drive assembly 20 by supports 28 to guide the rope 18 through the traction sheave 24. However, it should be apparent that the guide assembly 26 can be located anywhere along the rope path.

Figure 2:
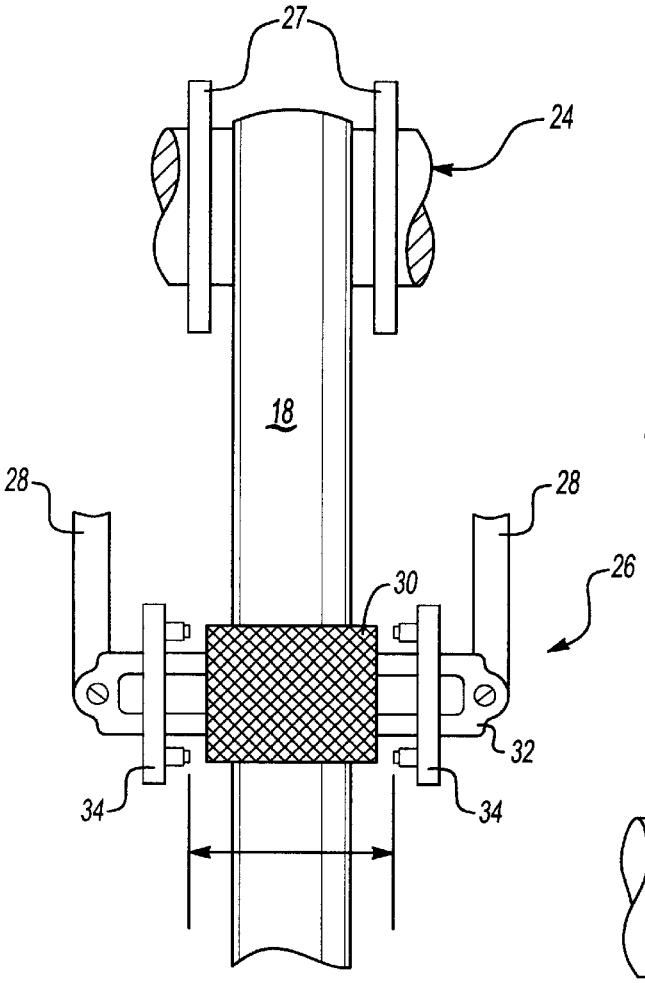
FIG. 2 is an expanded view of the slideably mounted magnetic guide.

Referring to FIG. 2, an expanded view of the flat rope 18 and the guide assembly 26 is illustrated. The flat rope 18 is routed along the sheave 24 between belt separators 27 and through the guide assembly 26. The guide assembly 26 preferably includes a magnetic guide portion 30 that receives the flat belt 18.

The magnetic guide portion 30 is preferably slideably mounted on a slide assembly 32 to mechanically compensate for side to side migration of the flat belt 18. As the flat rope 18 is driven by the sheave 24, the flat rope 18 typically migrates from side to side between the belt separators 27. During migration of the flat rope 18 along the sheave 24, the magnetic guide portion 30 slides along the slide assembly 32. Preferably, the magnetic guide portion 30 slides between the stops 34 and contact between the flat rope 18 and the belt separator 27 is prevented by the cooperation between the guide portion 30 and the stop 34 at each side of the slide assembly 32.

Figure 3:
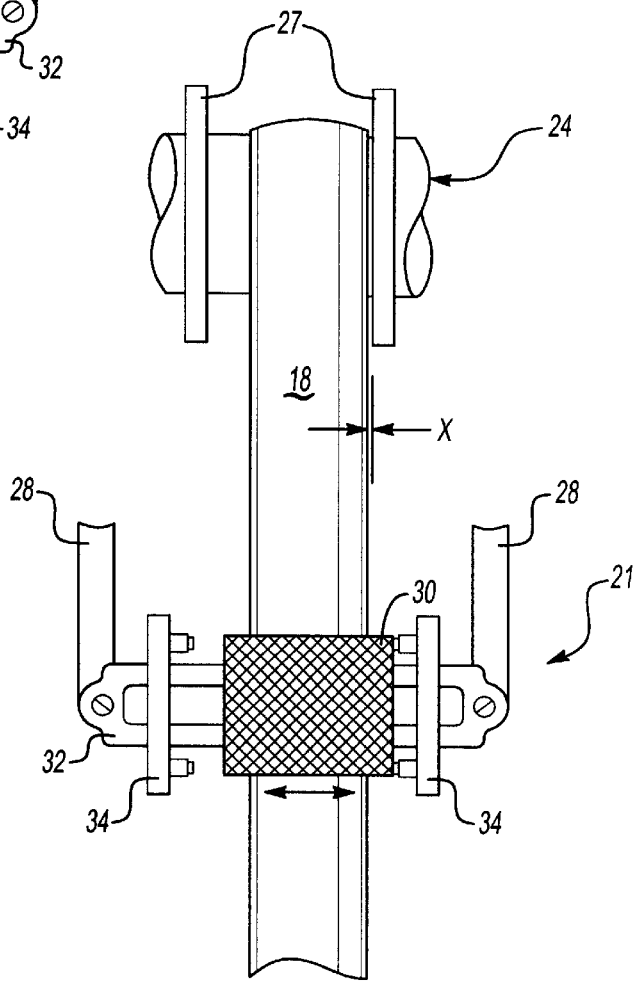
FIG. 3 is a an expanded view of the slideably mounted magnetic guide of FIG. 2 in a second position.

FIG. 3 illustrates a movement of the magnetic guide 30 to one side of the slide assembly 32 compared to the position shown in FIG. 2. Preferably, when the magnetic guide 30 contacts the stop 34, a clearance distance X is maintained between the flat rope 18 and the belt separators 27. The clearance distance X operates to prevent contact between the flat rope 18 and the belt separators 27, along with the resulting friction.

It should be apparent that the guide assembly 26 can also be rigidly mounted along the path of the flat rope 18. Further, should the flat rope 18 have a known preexisting tendency to migrate to only one side, the magnetic guide 30 can be offset relative to the ideal flat rope 18 path to correct such a tendency. For example, should the flat rope 18 always tend to move to an outside belt separator 27, the magnetic guide can be rigidly mounted toward the inside belt separator 27 to oppose this preexisting tendency.

Figure 4:
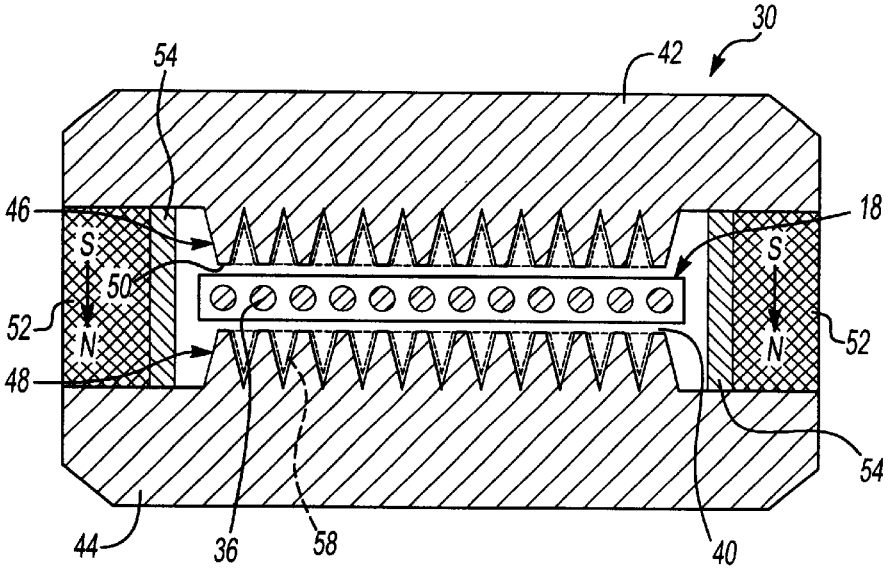
FIG. 4 is a sectional view of the guide assembly illustrating the flat rope passing through the magnetic guide.

Referring to FIG. 4, a sectional view of the guide assembly 26 illustrates the path of the flat rope 18 through the magnetic guide 30. The flat rope 18 includes a plurality of ferromagnetic wires 36 encased in a jacket 38. The jacket 38 preferably is a polyurethane material that maintains a lateral arrangement (according to the drawing) of the ferromagnetic wires 36 within the flat rope 18.

The flat rope 18 is guided through an opening 40 defined between a first ferromagnetic flux concentrator 42 and a second ferromagnetic flux concentrator 44. Each of the flux concentrators 42 and 44 includes a first set of teeth 46 and second set of teeth 48 that face the opening 40. The teeth 46 and 48 preferably are manufactured of a ferromagnetic material such as steel and are of a trapezoidal or triangular shape having a chamfered end 50. Preferably, the number of teeth 46 and 48 on each flux concentrator 42 and 44 is equivalent to the number of ferromagnetic wires 36. In one example implementation of this invention, the flat rope 18 includes twelve (12) ferromagnetic wires 36 and each of the first and second flux concentrators includes twelve (12) teeth each. Each tooth 46 of the first flux concentrator 42 faces an associated tooth 48 of the second flux concentrator 44. One of the ferromagnetic wires 36 preferably is between each associated grouping of a tooth 46 and a tooth 48.

To generate a magnetic field, a magnet 52 is located between the flux concentrators 42 and 44 at each side of the flat rope 18. The magnets 52 are located on each side of the flat rope 18 aligned with the opening 40. The magnetic poles preferably are oriented in the same direction transverse to the flat rope 18.

To prevent direct contact between the flat rope 18 and the magnets 52, a non-magnetic separator 54 such as a stainless steel plate is located between each magnet 52 and the belt 18. The non-magnetic separators 54 also direct the magnetic field into the flux concentrators 42 and 44. The non-magnetic separators 54 preferably are located within one half of the tooth pitch (i.e., half the distance between each ferromagnetic wire 36) on each side of the belt 18 to assure that the ferromagnetic wires 36 are oriented in the direct path of the magnetic field between the teeth 46 and 48. In other words, the total lateral width of the opening 40 should be less than the flat belt 18 lateral width plus one tooth pitch or the distance between the centers of two ferromagnetic wires.

Although permanent magnets are illustrated in one disclosed embodiment of the present invention, it should be realized that electromagnets could also be used. By utilizing electro-magnets, the magnetic guide 30 can be selectively energized and operated such that any opposition generated by the magnetic field can be selectively eliminated. For example the electromagnets can be activated when the magnetic guide 30 slides into contact with one of the stops 34 (FIG. 3). Accordingly, the magnetic guide 30 is selectively activated when desired or necessary to maintain the clearance distance X between the flat belt 18 and the belt separators 27.

Figure 5A:
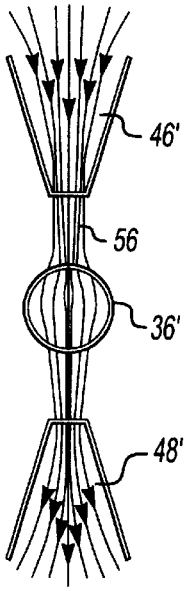
FIG. 5A illustrates a single ferromagnetic wire of the flat belt centered between a first and second tooth and the resulting magnetic flux.

Referring to FIG. 5A, a single ferromagnetic wire 36' is illustrated between a tooth 46' from the first set of teeth 46 and a tooth 48' from the second set of teeth 48. The ferromagnetic flux concentrators 42 and 44 concentrate the magnetic field from the magnets 52 into the ends of the teeth 46' and 48'. Due to the polarity directions of the magnets 52, the magnetic field is concentrated at the tip of each tooth 46' in the first set of teeth 46. The magnetic field flows from each tooth 46' of the first set of teeth 46 across the opening 40 to the corresponding tooth 48' of the second set of teeth 48. The magnetic field is therefore concentrated as a magnetic flux between a facing or corresponding pair of teeth 46' and 48'. As the flow of magnetic flux (schematically illustrated as 56) is between the ends of each tooth 46' and 48', the flux 56 crosses the ferromagnetic wire 36'. In this way the ferromagnetic wire 36' becomes a part of the magnetic circuit.

Figure 5B:
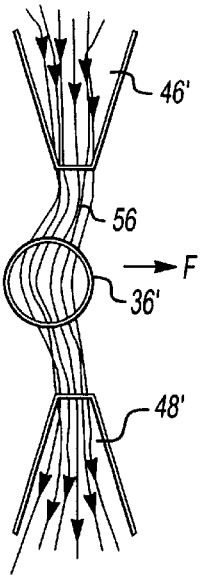
FIG. 5B illustrates the single ferromagnetic wire of FIG. 5A laterally offset from between the first and second tooth and the resulting magnetic flux.

The shortest distance for the magnetic flux is obtained when the ferromagnetic wire 36' is directly aligned between the facing teeth 46', 48' as the magnetic circuit will then have minimal reluctance. The magnetic flux 56 crossing the ferromagnetic wire 36' creates a centralizing force F (FIG. 5B) which attempts to minimize the reluctance and maintain the ferromagnetic wire 36' in the center between each tooth 46', 48'. This central position is a stable position into which the ferromagnetic wire 36' will always be biased.

If the ferromagnetic wire 36' is laterally moved away from the central position between the teeth 46' and 48', the reluctance in the magnetic circuit will increase and the magnetic flux 56 will force the ferromagnetic wire 36' back to the stable or minimal reluctance position (FIG. 5A). As the centralizing force F acts on each ferromagnetic wire 36, the flat rope 18 is magnetically laterally centered within the opening 40 of the magnetic guide 30 and side to side migration of the flat rope 18 is dampened. Further, because the flat rope 18 most preferably is laterally restrained by the non-magnetic separators 54, which are positioned as described above, the flat belt 18 is prevented from laterally shifting one complete ferromagnetic wire 36. The non-magnetic separators 54 thereby mechanically retain the magnetic circuit of one discrete ferromagnetic wire 36 in alignment with a pair of facing teeth 46' and 48'.

Although magnetically and mechanically stabilized in a lateral direction between the teeth 46 and 48, the flat rope 18 does not have a stable position in the transverse (perpendicular into the rope) direction. The flat rope 18 therefore tends to approach the teeth 46 and 48 and it is preferred to cover teeth with a low friction material 58 (FIG.

4) such as Teflon or the like. It is further preferred that the openings between the teeth be completely filled with the low friction material to create a smooth slot-like opening for the flat rope 18.

Each specific embodiment of this invention will depend on the specific application and such details as, for example, the number and diameter of the ferromagnetic wires, the number and dimensions of the teeth, the distance between the flat rope and the teeth, and the strength of the magnets. One example implementation of this invention includes a 3.4 mm thick flat rope having twelve (12) ferromagnetic wires laterally spaced approximately 1.6 mm located within a magnetic guide having two sets of twelve (12) teeth extending over a 30 mm lateral and 10 mm longitudinal length relative to the path of the flat rope. Each tooth is approximately 3.5 mm tall with a 0.6 mm chamfered end. When the flat rope is moved laterally 0.5 mm off-center, a 4 Newton centering force was generated.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. An elevator guide system comprising:

a magnetic guide assembly having an opening and generating a magnetic field across said opening;

an elevator rope having a plurality of ferromagnetic wires, said elevator rope being movable through said opening such that said ferromagnetic wires are exposed to said magnetic field to magnetically constrain lateral movement of said elevator rope within said guide assembly.

2. The system as recited in claim 1, wherein said elevator rope is a substantially flat belt, said substantially flat belt maintaining said plurality ferromagnetic wires in a lateral alignment.

3. The system as recited in claim 1, wherein said magnetic guide assembly includes a first ferromagnetic flux concentrator located adjacent said opening, and a second ferromagnetic flux concentrator located adjacent said opening and opposite said first ferromagnetic flux concentrator.

4. The system as recited in claim 3, wherein said first ferromagnetic flux concentrator includes a first plurality of teeth and said second ferromagnetic flux concentrator includes a second plurality of teeth, said first plurality of teeth facing said second plurality of teeth across said opening with each of said first plurality of teeth corresponding to one of said second plurality of teeth.

5. The system as recited in claim 4, wherein each of said first plurality of teeth and each of said second plurality of teeth correspond with one of said plurality of ferromagnetic wires of said elevator rope.

6. The system as recited in claim 1, including a slide assembly mounting said magnetic guide assembly.

7. The system as recited in claim 6, including a stop to laterally restrain said magnetic guide assembly to a predetermined movement range.

8. The system as recited in claim 7, wherein said magnetic guide assembly is selectively activated in response to contact between said magnetic guide assembly and said stop.

9. A method of guiding an elevator rope having a plurality of ferromagnetic wires, comprising the steps of:

(1) routing the elevator rope through a magnetic field;

(2) concentrating said magnetic field to generate a magnetic flux at discreet locations associated with each of said plurality of ferromagnetic wires to generate a centralizing force that magnetically constrains lateral movement of the elevator rope.

10. A method as recited in claim 9, including mechanically limiting a lateral movement of the rope relative to the magnetic field.

* * * * *